US012169115B2

(12) United States Patent
De Masi

(10) Patent No.: US 12,169,115 B2
(45) Date of Patent: Dec. 17, 2024

(54) CHEST WORN UTILITY POUCH FOR WEAPON

(71) Applicant: James De Masi, Fullerton, CA (US)

(72) Inventor: James De Masi, Fullerton, CA (US)

( * ) Notice: Subject to any disclaimer, the term of this patent is extended or adjusted under 35 U.S.C. 154(b) by 280 days.

(21) Appl. No.: 17/950,827

(22) Filed: Sep. 22, 2022

(65) Prior Publication Data

US 2024/0102771 A1 Mar. 28, 2024

(51) Int. Cl.

| | |
|---|---|
| ***A45F 3/02*** | (2006.01) |
| ***F41C 33/02*** | (2006.01) |
| ***F41C 33/04*** | (2006.01) |
| *F41C 33/08* | (2006.01) |

(52) U.S. Cl.

CPC ..... *F41C 33/0209* (2013.01); *F41C 33/029* (2013.01); *F41C 33/043* (2013.01); *F41C 33/048* (2013.01); *F41C 33/08* (2013.01)

(58) Field of Classification Search

CPC ..... F41C 33/0209; F41C 33/029; F41C 33/043; F41C 33/048; A45F 3/02; A45F 3/005; A45F 2200/0591

USPC ..... 224/597

See application file for complete search history.

(56) References Cited

U.S. PATENT DOCUMENTS 4,282,657 A * 8/1981 Antonious ..... A43C 11/008 36/114
4,545,414 A * 10/1985 Baum ..... A45C 11/38 224/664
4,966,320 A * 10/1990 DeSantis ..... F41C 33/0209 224/931
5,103,975 A * 4/1992 Liu ..... A45C 13/26 190/115
5,294,031 A * 3/1994 Volpei ..... F41C 33/048 224/664
5,873,504 A * 2/1999 Farmer ..... A45C 7/0086 190/110
5,893,496 A * 4/1999 Katz ..... F21V 21/084 224/675
6,390,260 B1 * 5/2002 Roegner ..... A47D 13/063 5/655
8,789,734 B2 * 7/2014 Cross ..... A45C 13/04 224/601

(Continued)

FOREIGN PATENT DOCUMENTS

EP 0018074 A1 10/1980

*Primary Examiner* — Adam J Waggenspack

(74) *Attorney, Agent, or Firm* — McConnell Law Firm P.C.; Robert McConnell

(57) ABSTRACT

Chest worn utility pouch designed to provide easy, quick and safe access to a weapon, specifically a handgun. The pouch makes it easy for a user to grab, install and wear on their body and provides secure and quick access to the weapon stored inside. The pouch is supported by a neck lanyard for suspension and a waist lanyard for securing to the body. Requires no fine motor skills to operate thus offsetting the adverse effects of adrenaline. The rear pocket for a communications device affords the wearer hands free communications with the police, thus reducing the chances of criminal prosecution or civil penalty, post incident. The pouch conceals the firearm from view, thus allowing for possible de-escalation. Further, the present invention is designed to fit inside most gun safes or hides so that firearms are immediately deployable in a safe, but expeditious manner.

13 Claims, 6 Drawing Sheets

(56) References Cited

U.S. PATENT DOCUMENTS

| | | | | |
|---|---|---|---|---|
| 10,231,533 | B2 * | 3/2019 | Vaughan | A45F 3/06 |
| 2003/0024960 | A1 * | 2/2003 | Greenstein | A45C 13/02 224/608 |
| 2009/0218379 | A1 * | 9/2009 | Harris | F41C 33/0209 224/661 |

* cited by examiner

CHEST WORN UTILITY POUCH FOR WEAPON

BACKGROUND OF THE INVENTION

Field of the Invention

The present invention relates to holsters or carrying bags for weapons, including firearms. In today's world, may people protect themselves and/or their homes with weapons, including firearms. The safe storage and deployment of these weapons is critical to weapon/firearm safety and prevention of accidents. With the current devices available in the art, safe deployment of a firearm poses many problems. Unholstered firearms are prone to alarm by-standers, make it difficult to manipulate other tools, and increases the chances of unintended accidents. Calling the police while holding a firearm occupies both hands and makes it difficult to complete other tasks. Approaching a confrontation with an exposed firearm can make any chance of de-escalation difficult. Manipulating buckles or straps commonly found on most chest holsters can be difficult in times of extreme stress.

Most similar typed holsters are too large to fit inside gun safes or furniture hides. Most comparable holsters require fine motor skills to don and operate. Most do not allow hands free communication with law enforcement as part of their design. This system is simple to use, swift to don, under any conditions.

SUMMARY OF THE INVENTION

The utility pouch of the present invention is designed to provide easy, quick and safe access to a weapon, specifically a handgun. The present invention makes it easy for a user to grab, install and wear on their body, and provides secure and quick access to the weapon stored inside. The pouch is supported by a neck lanyard for suspension and a waist lanyard for securing to the body. It requires no fine motor skills to operate thus offsetting the adverse effects of adrenaline. The rear pocket for a communications device affords the wearer hands free communications with the police, thus reducing the chances of criminal prosecution or civil penalty, post incident. The pouch conceals the firearm from view, thus allowing for possible de-escalation. Further, the present invention is designed to fit inside most gun safes or hides so that firearms are immediately deployable in a safe, but expeditious manner.

DESCRIPTION OF THE PREFERRED EMBODIMENT

The following detailed description refers to the preferred embodiment of the disclosed invention as shown in the attached figures and in the below description. This detailed description is not meant to limit the scope of the invention in any way but is intended to disclose the preferred embodiment/best mode of the invention at the time of filing this application.

Figure 1:
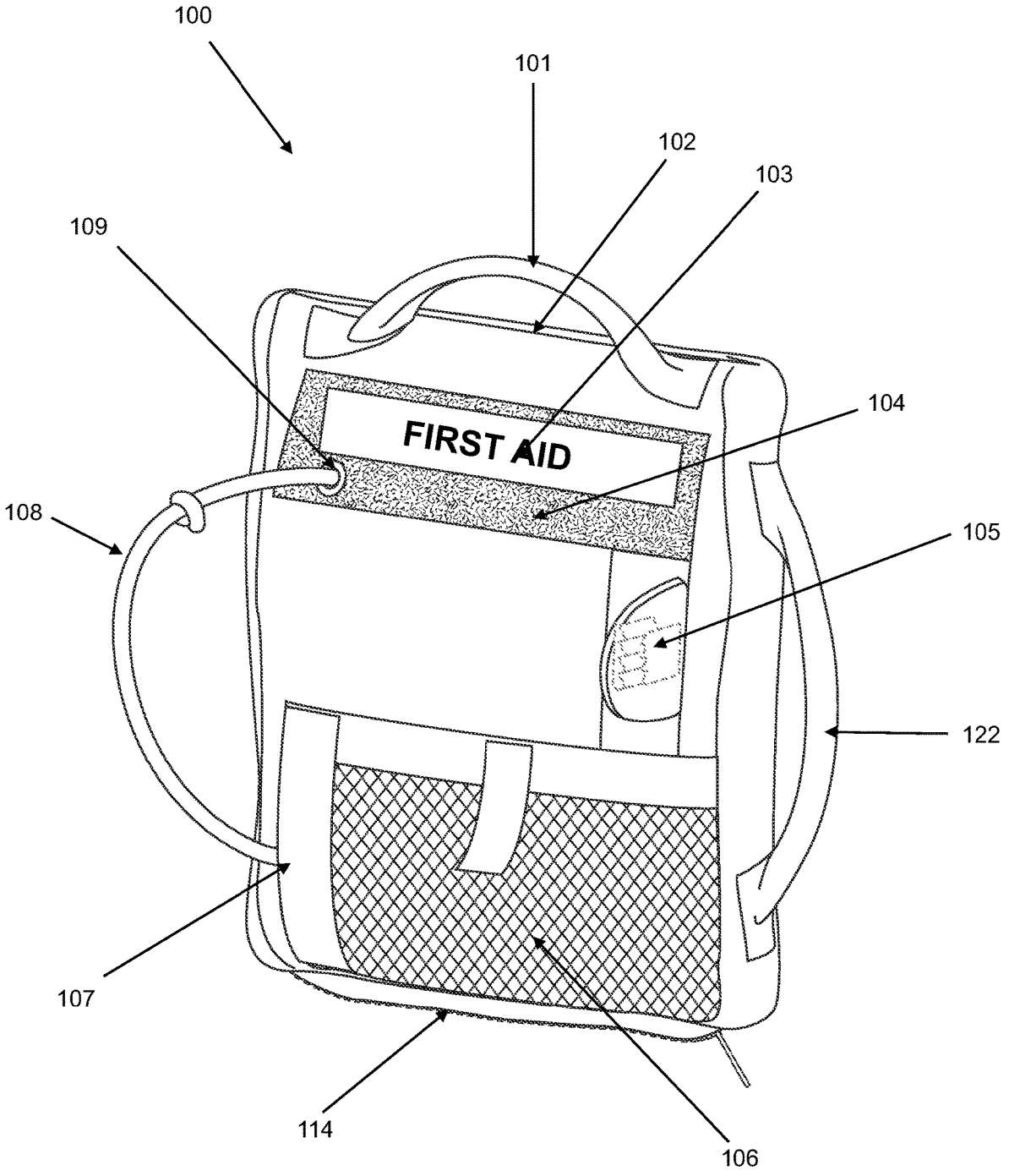
FIG. 1 is a front view of the chest worn utility pouch for weapon.

FIG. 1 is a front view of the utility pouch 100 (herein "pouch") of the present invention. Top handle 101 is located at the top of pouch 100 and allows the used to carry the pouch upright. Main compartment opening 102 is also located at the top of pouch 100 and opens the main compartment where the weapon is stored. This opening will be shown in more detail in relation to FIG. 3*a*. Placard 103 is fixed to the front of pouch 100 and allows the user to place a label on the front of the device. In this embodiment, the words included on placard 103 are "First Aid," however any message may be included on placard 103. The label "First Aid" is utilized to divert attention from the actual contents of the pouch to unaffiliated third-parties. Placard 103 is fixed to placard attachment area 104. In the preferred embodiment, placard attachment area 104 is formed of loop material that securely fastens to hook material on the rear of placard 103. This allows easy attachment and removal of placard 103 from placard attachment area 104 and pouch 100.

Waist lanyard 108 is formed of rope and is wrapped around the midsection of the user to secure pouch 100 to the user's body. In the preferred embodiment the type of rope is nylon, but any type of rope known in the art could be used. Waist lanyard 108 has a first end secured by waist lanyard grommet 109 and a second unattached end that, when not in use, is stored in waist lanyard pocket 107. When pouch 100 is worn by the user, waist lanyard 108 is deployed from waist lanyard pocket 107 and wrapped around the user's midsection. In this deployed state, the first end of waist lanyard 108 is secured by waist lanyard grommet 109 and the second end, after being wrapped around the user's midsection, is secured to waist lanyard cleat 105. Waist lanyard grommet 109 is a circular grommet that allows deployment of the nylon rope of waist lanyard 108. Waist lanyard cleat 105 is an oval shaped device with gripping ridges along the inner edge. When the second end of waist lanyard 108 is wrapped around waist lanyard cleat 105 which provides secure attachment of the lanyard. Waist lanyard 108 is located above the waist lanyard pocket in order to provide user access to waist lanyard 108 in the most expeditious and secure way. Side handle 122 allows the user to carry the pouch from the side if they so choose.

In another embodiment, an additional waist lanyard cleat 105 could be affixed to the opposite side of pouch to facilitate a reverse direction of the operation. Further, other designs for waist lanyard cleat could be utilized including many well known in the art.

To store waist lanyard 108, the user removes the waist lanyard 108 from the waist lanyard cleat 105 and places waist lanyard 108 into waist lanyard pocket 107.

Front compartment 106 is formed of mesh in the preferred embodiment and may be utilized to store any small items desired to be carried with the pouch 100.

In the preferred embodiment, waist lanyard 108 is nylon rope, but other suitable materials such as polyester, cotton, polypropylene, polyethylene, carbon fiber, and hemp could be used.

Pouch 100 is manufactured out of a durable material such as Cordura™ or other nylon materials utilized for manufacture of luggage or other types of bags used for storage and carrying of items. Materials such as ballistic nylon, nylon, polyester, leather, imitation leather, polycarbonate, polypropylene, Kevlar and aluminum could be used, as well as any material well known in the art. The pouch 100 of the present invention is assembled by cutting and sewing panels but other manufacturing methods well known in the art could be used.

Figure 2:
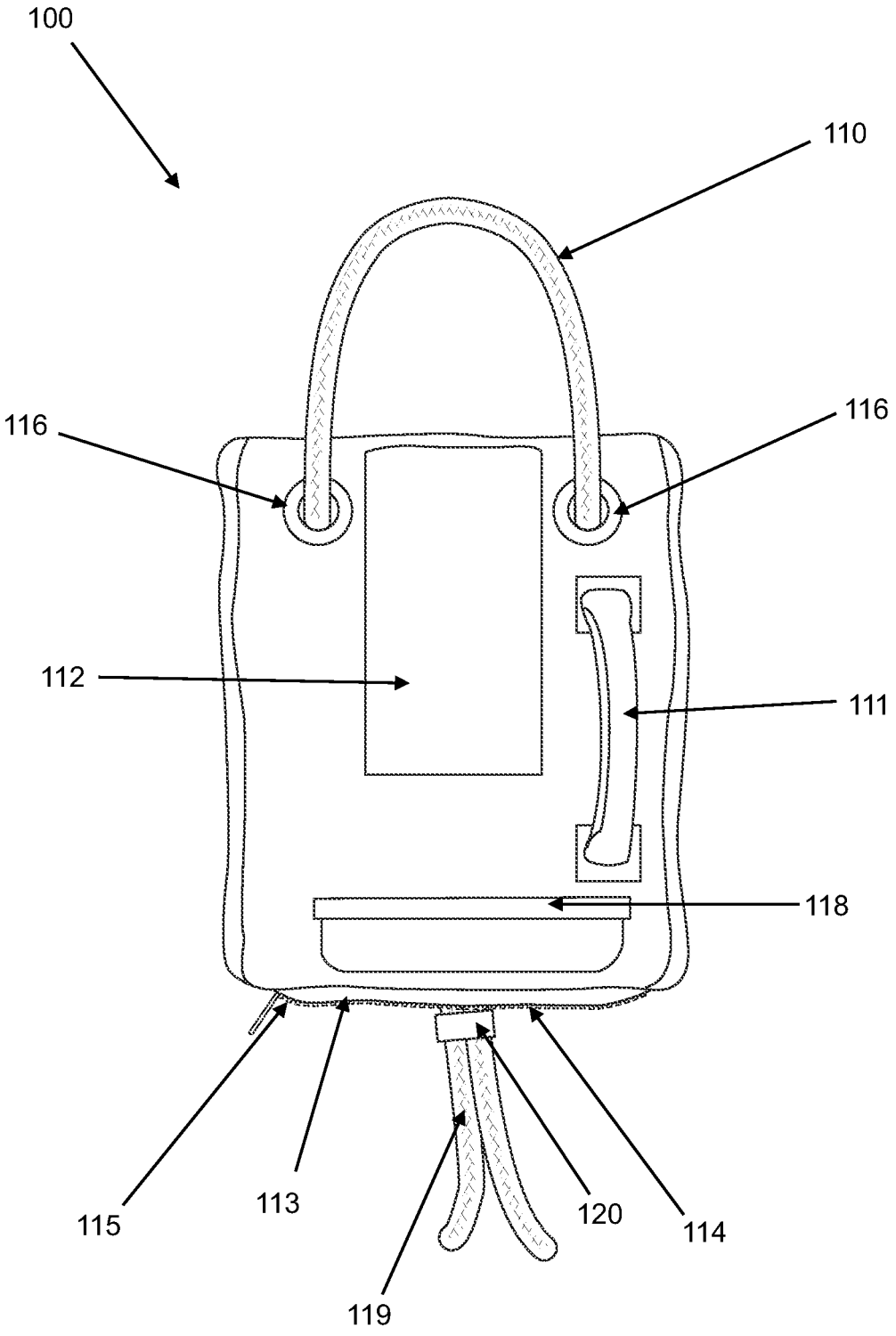
FIG. 2 is a rear view of the chest worn utility pouch for weapon.

FIG. 2 is a rear view of pouch 100. Neck lanyard 110 has a deployed state and a stored state. In the deployed state, neck lanyard is deployed to fit around the user's neck to support pouch 100 when worn on the user's chest. In the stored state, neck lanyard 110 is retracted into rear compartment 113 located on the rear of pouch 100. Rear compartment 113 is accessed through rear compartment opening 114. Rear compartment opening 114 is opened and closed using rear compartment enclosure 115, in the preferred embodiment a zipper. Other enclosure means well known in the art could be used such as hook and loop/Velcro™. In the preferred embodiment, neck lanyard 110 is nylon rope, but other suitable materials such as polyester, cotton, polypropylene, polyethylene, carbon fiber, and hemp could be used.

To deploy neck lanyard 110, the user pulls neck lanyard 110 through neck grommets 116. Neck grommets 116 are circular metal grommets that allow the lanyard to be pulled smoothly through them and protect the pouch material from wear. A fabric sinch 120 is attached to the neck lanyard ends 119 of neck lanyard 110 and is used to prevent neck lanyard ends 119 from pulling through neck grommets 116. Other methods utilized could be metal clips, knots on the ends of neck lanyard or any other method well known in the art. Neck grommets 116 are installed by crimping or sewing the grommets to the fabric of pouch 100.

To store neck lanyard 110, the user opens rear compartment enclosure 115, reaches through rear compartment opening 114 and pulls the ends of neck lanyard 110 so that it is fully stored in rear compartment 113.

Mobile phone compartment 112 is also shown in the rear of pouch 100. Mobile phone compartment 112 is used to store a communications device for easy user access. This allows quick communication with authorities or other parties when necessary. In the preferred embodiment, mobile phone compartment 112 is open at the top for easy access by the user. In an optional embodiment, mobile phone compartment 112 is opened and closed by mobile phone compartment enclosure 118, in the preferred embodiment a zipper, though any other enclosure method well known in the art could be used, such as hook and loop. Further rear handle 111 allows another grip method for carrying pouch 100 when not worn around the user's neck.

Neck lanyard 110 is deployed and placed over the user's neck. Then waist lanyard 108 is wrapped around the user's midsection and secured by waist lanyard grommet 109 and waist lanyard cleat 105. When in this secure position, the user has easy access to the main pocket of pouch 100.

In this view, the rear of pouch 100 with neck lanyard 110 pulled out of rear compartment 113. In this view, rear compartment opening 114 and rear compartment enclosure 115 are open and neck lanyard ends 119 are visible. Also visible are neck lanyard sinch 120 which prevent neck lanyard 110 from being pulled through neck lanyard grommets 116. To fully store neck lanyard 110, neck lanyard ends 119 are stored in rear compartment 113 and rear compartment enclosure 115 is closed.

Figure 3A:
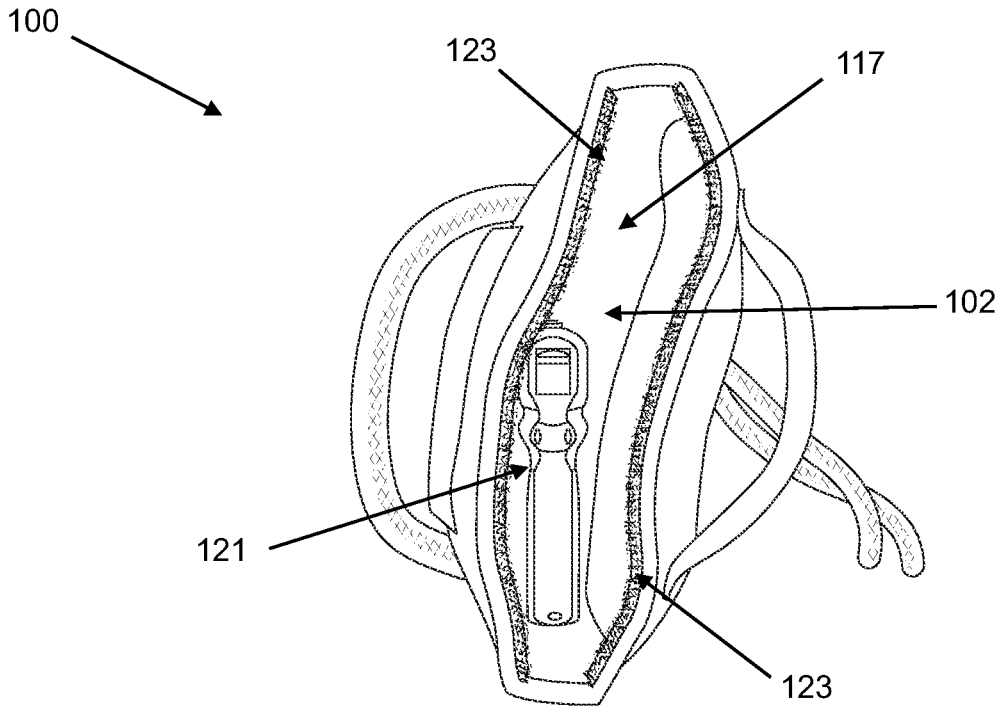
FIG. 3*a* is a top view of the chest worn utility pouch for weapon.

FIG. 3*a* shows a view of the top of pouch 100 with main compartment 117 open for access to the compartment. Main compartment 117 is accessed through main compartment opening 102 which is opened and closed by main compartment enclosure 123. In the preferred embodiment, main compartment enclosure 123 is a zipper but other enclosure methods could be used such as hook and loop or any other well known in the art. When the user is wearing the pouch 100 around their neck, they have easy access to the main compartment 117 at the top of the pouch. In this view main compartment 117 is utilized to store weapon 121, in this case a handgun, but could be used to store a taser, pepper spray/mace, a knife or any other type of weapon. Further, main compartment 117 may also be used to store any other item to which the user needs fast and convenient access, especially in an emergency situation. Main compartment 117 is formed of folded fabric material, generally a softer material that the durable outer shell of pouch 100. This material could be nylon but other suitable materials such as plastic, metal composites, Kevlar, leather and/or imitation leather could be used.

Figure 3B:
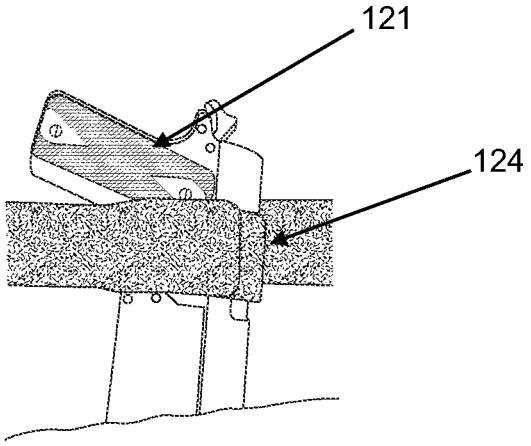
FIG. 3*b* is a view of the weapon installed in the interior of the utility pouch for weapon.

FIG. 3*b* shows weapon 121 secured by weapon strap 124. Weapon strap 124 orients the weapon in the pouch and prevents unintentional pull of the trigger of a handgun.

Figure 4:
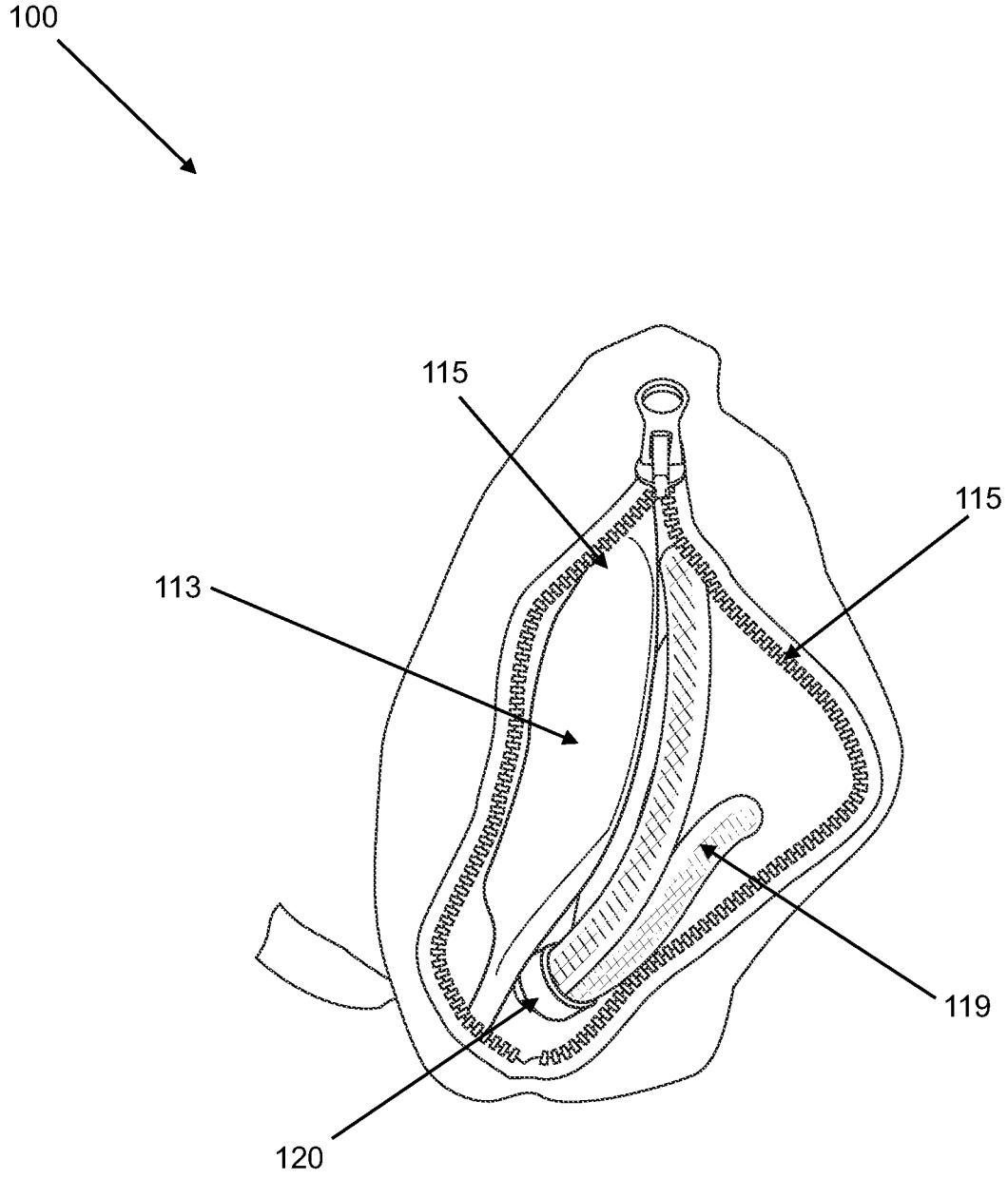
FIG. 4 is a bottom view of the chest worn utility pouch for weapon with the rear compartment open.

FIG. 4 shows a bottom view of utility pouch 100. In this view, rear compartment 113 is shown with rear compartment opening 114 and rear compartment enclosure 115 open. Neck lanyard ends 119 and neck lanyard sinch 120 are also visible. In this embodiment rear compartment enclosure 115 is a zipper.

Figure 5:
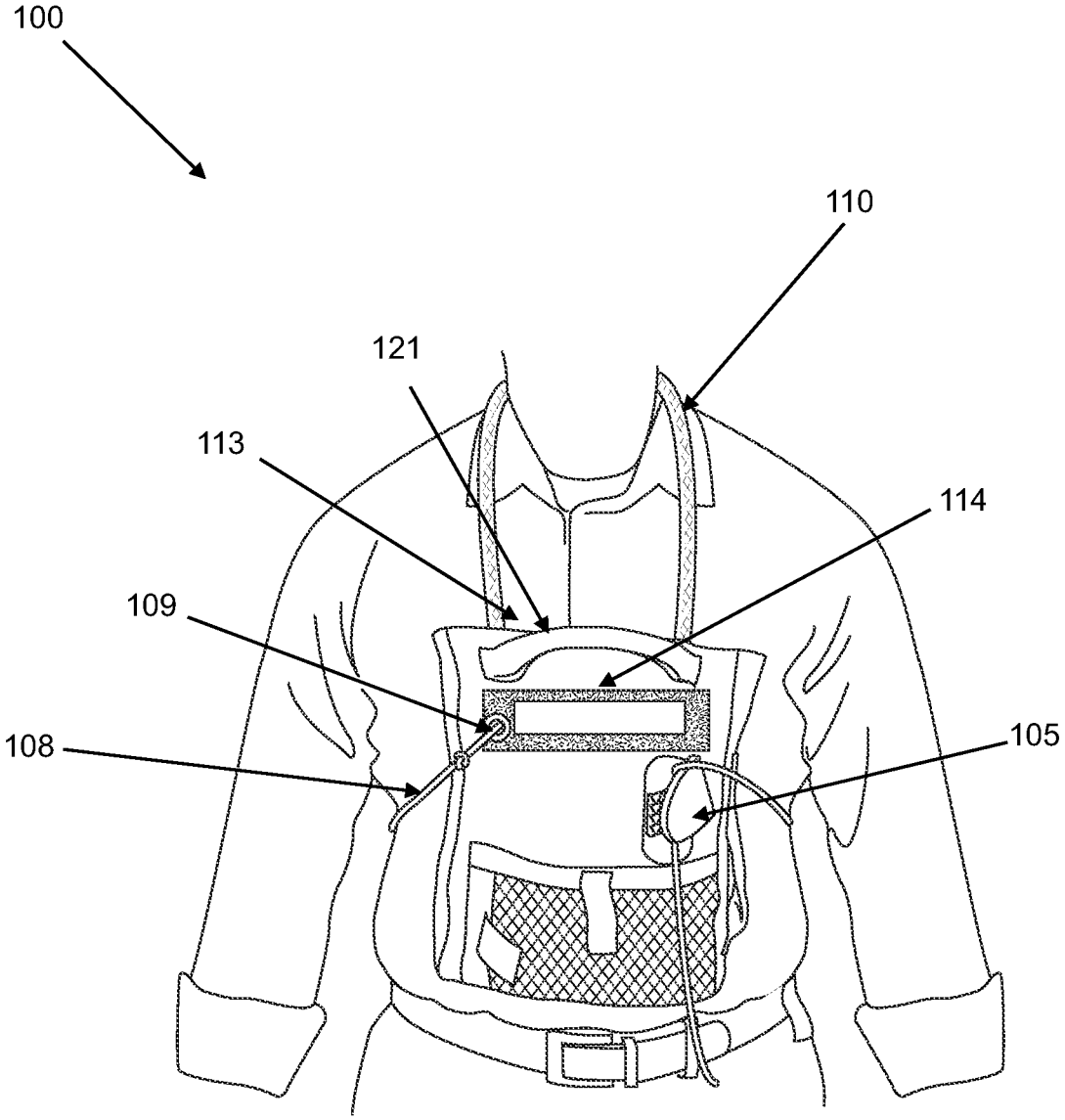
FIG. 5 is a view of chest worn utility pouch for weapon being worn by a user.

FIG. 5 shows a view of pouch 100 being worn by a user. Neck lanyard 110 is deployed and placed around the user's neck. Waist lanyard 108 is deployed and wrapped around the user's midsection. Waist lanyard 108 is secured by waist lanyard grommet 109 and waist lanyard cleat 105. Weapon 121 (not shown) is stored in main compartment 117 and accessed through main compartment opening 102.

Figure 6:
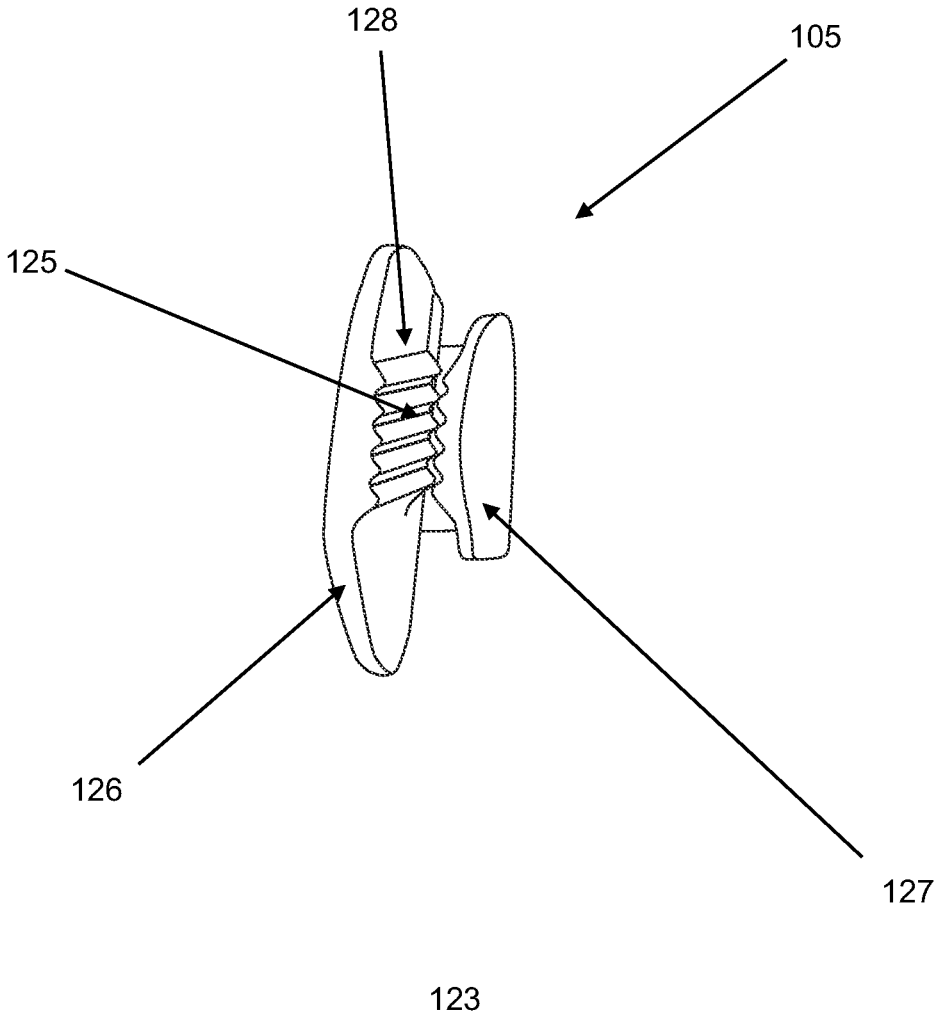
FIG. 6 is a detail view of the waist lanyard cleat.

FIG. 6 is a detailed view of waist lanyard cleat 105. Waist lanyard cleat 105 is comprised of base 126, neck 128, top 127 and securing ridges 125. When waist lanyard 108 is wrapped around neck 128, securing ridges 125 provide friction to prevent unraveling of waist lanyard 108, thus providing a secure attachment point for waist lanyard 108 and a secure fit around a user's waist.

Although the present invention has been described in relation to the above disclosed preferred embodiment, many modifications in design, implementation, systems and execution are possible while still maintaining the novel features and advantages of the invention. The preferred embodiment is not meant to limit the scope of the patent in any way, and it should be given the broadest possible interpretation consistent with the language of the disclosure on the whole.

The invention claimed is:

1. A utility pouch for a weapon comprising:

an enclosed pouch with a top, a bottom and two sides, the enclosed pouch having a main compartment for the weapon, the main compartment being accessible through a main compartment opening located at the top of the pouch, the main compartment opening being openable and securely closeable;

a neck lanyard attached to the main pouch, the neck lanyard being extendable to fit over a user's neck and to support the pouch, the neck lanyard having a first end and a second end and a circular cross section, the neck lanyard being retractable into a neck lanyard storage compartment by routing the first end of the neck lanyard through a first circular grommet and routing the second end of the neck lanyard through a second circular grommet;

a waist lanyard for securing the pouch around the midsection of the user, the waist lanyard being extendable to fit around the user's midsection and to secure the pouch to the user's body, the waist lanyard having a first end and a second end and a circular cross section, the first end of the waist lanyard being secured by a third circular grommet and the second end of the waist lanyard being retractable into a waist lanyard storage compartment;

a waist lanyard cleat for securing the second end of the waist lanyard; and a communications pocket for storing a communication device.

2. The utility pouch of claim 1 where the communications pocket is attached to the exterior of the pouch.

3. The utility pouch of claim 1 further comprising a front storage pocket.

4. The utility pouch of claim 1 further comprising a placard that is attachable and detachable from the front of the pouch.

5. The utility pouch of claim 4 where the placard is attachable and detachable with hook and loop material.

6. The utility pouch of claim 1 where the main compartment opening is openable and closeable with a zipper.

7. The utility pouch of claim 1 where the neck lanyard storage compartment is openable and closeable with a zipper.

8. The utility pouch of claim 1 where the waist lanyard storage compartment is openable and closeable with a zipper.

9. The utility pouch of claim 1 where the pouch further comprises a handle located at the top of the pouch.

10. The utility pouch of claim 1 where the pouch further comprises a handle located at one side of the pouch.

11. The utility pouch of claim 1 where the neck lanyard is made of a material selected from the group consisting of nylon, polyester, cotton, polypropylene, polyethylene, carbon fiber, and hemp.

12. The utility pouch of claim 1 where the waist lanyard is made of a material selected from the group consisting of nylon, polyester, cotton, polypropylene, polyethylene, carbon fiber, and hemp.

13. The utility pouch of claim 1 where the pouch is made of a material selected from the group consisting of ballistic nylon, nylon, polyester, leather, imitation leather, polycarbonate, polypropylene, Kevlar and aluminum.

* * * * *